United States Patent [19]

Hackman et al.

[11] 4,154,185

[45] May 15, 1979

[54] SUBMERSIBLE APPARATUS FOR EVACUATING SEAWATER FROM SUCTION-TYPE WORK-HANDLING GRIPPER MEMBERS

[75] Inventors: Donald J. Hackman, Columbus; Roger L. Brunel, Grove City, both of Ohio

[73] Assignee: The United States of America as represented by the Secretary of the Navy, Washington, D.C.

[21] Appl. No.: 840,865

[22] Filed: Oct. 11, 1977

[51] Int. Cl.[2] ..... B63C 7/22

[52] U.S. Cl. ..... 114/50; 294/64 R; 417/375

[58] Field of Search ..... 114/44, 50, 51, 52, 114/16 R, 312; 61/69 R; 417/321, 390, 375; 294/64 R; 405/185, 193

[56] References Cited

U.S. PATENT DOCUMENTS

| | | | |
|---|---|---|---|
| 2,347,491 | 4/1944 | Lente | 114/51 |
| 3,398,694 | 8/1968 | Lerch | 417/375 X |

FOREIGN PATENT DOCUMENTS

| | | | |
|---|---|---|---|
| 960248 | 12/1974 | Canada | 294/64 R |

*Primary Examiner*—Trygve M. Blix
*Assistant Examiner*—Sherman D. Basinger
*Attorney, Agent, or Firm*—Richard S. Sciascia; Paul N. Critchlow

[57] ABSTRACT

A light-walled portable casing, filled with a hydraulic fluid, contains a high-pressure water pump driven by a hydraulic fluid-driven motor. An externally-carried, suction-type gripper member engages the work object. Pumping evacuated seawater from the engaged surface to establish a secure differential-pressure hold-down force. A pressurized source of hydraulic fluid is applied through the casing to the motor. Fluid discharges from the motor directly into the casing to establish an interior casing pressure that pressure compensates the light-walled structure. Seawater evacuation eventually stalls the motor. When leakage occurs, pumping immediately resumes.

9 Claims, 4 Drawing Figures

SEAWATER EVACUATION SYSTEM

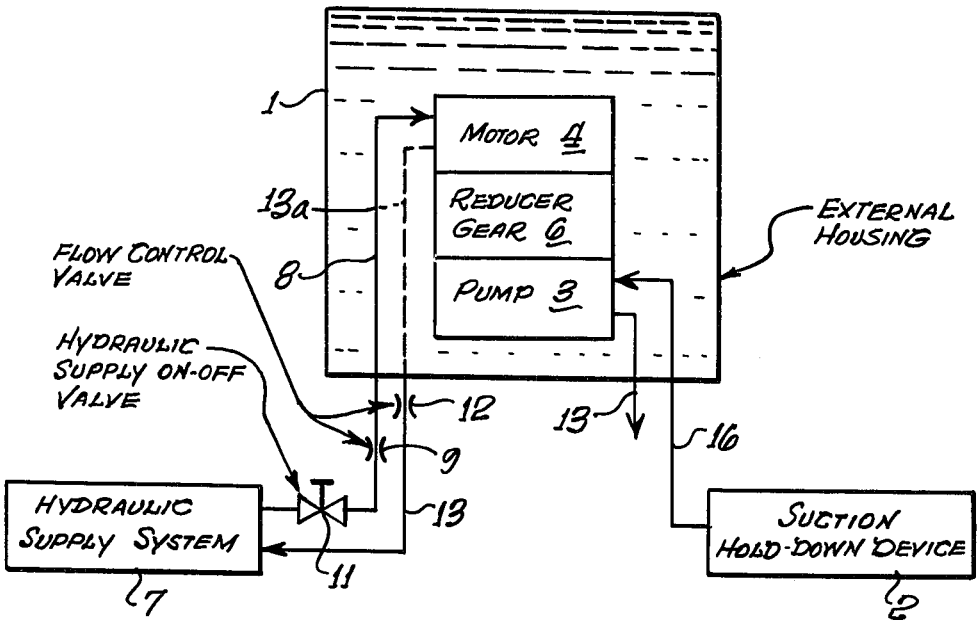
FIG. 1. SEAWATER EVACUATION SYSTEM
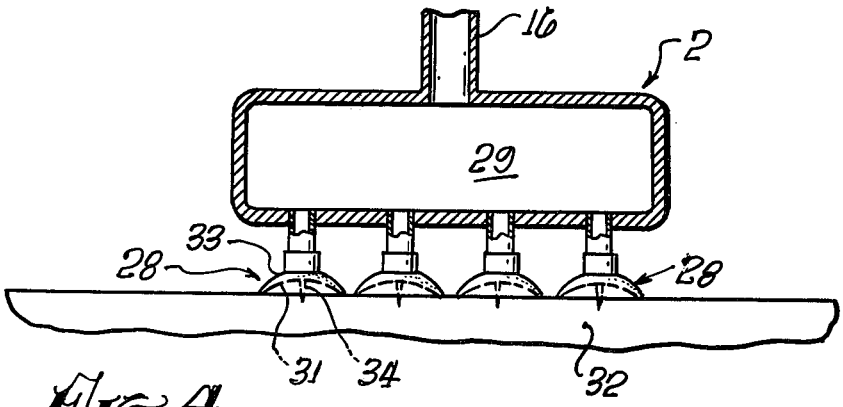
FIG. 4.

SUBMERSIBLE APPARATUS FOR EVACUATING SEAWATER FROM SUCTION-TYPE WORK-HANDLING GRIPPER MEMBERS

BACKGROUND OF THE INVENTION

The present invention relates to underwater work-handling operations and, in particular, to portable, self-contained seawater evacuation systems adapted to be hand-carried under water to the object to be worked.

Many salvage and other under water work-handling operations are conducted by submersibles or by divers using some sort of a gripping device such as manipulator jaws to engage the work object and permit it to be moved or lifted.

Jaw-type grippers are widely used. However, situations occur in which the work objects are too large to be securely grasped so that either large, cumbersome jaws must be substituted or some other form of gripper must be provided. Also, the jaw mechanisms are rather intricate and, at times, not too reliable.

For these and other situations, the use of suction-type grippers, such as gripping pads, has been suggested. In general, the idea is for a diver to apply a pad-like suction device to the work with the pad then being pumped to evacuate seawater from its engaged surface and establish a reduced pressure area or reduced suction force. Although such suction pads clearly can be used to advantage, their implementation in an efficient, reliable seawater evacuation system has posed problems particularly because of the need to establish the suction at the working depths. Large, expensive systems, which employ special support vessels and long suction lines, of course, are possible. However, many situations better are served by simpler, inexpensive systems or units which, for example, are sufficiently small and light weight to be easily transported by the divers and manually applied to the work. Also, for reasons of simplicity and to avoid the use of the long suction lines, such portable systems preferably should be in the form of self-contained units in the sense that the motive power for establishing the suction is contained in the portable unit carried by the diver.

The present invention principally is concerned with such light-weight portable and self-contained suction systems and has, as its principal object, the provision of light-weight, simple and inexpensive systems for use underwater in the high ambient pressures.

Generally, the purposes of the invention are achieved by mounting a motor-driven pump in a thin-walled, portable casing which carries the suction-type grippers. To permit the casing to withstand ambient pressures, it is filled with a pressurized hydraulic fluid. Specifically, the motor is a hydraulic drive motor with the hydraulic fluid supplied to it from a power source. However, instead of returning the motor discharge directly to source, the motor discharges the fluid directly into the casing which itself is connected to a return line. Supply pressures then can be adjusted to achieve an interior pressure sufficient to compensate for ambient pressures.

As a further feature, the gripper members, instead of being suction or reduced-pressure devices, are differential-pressure, hold-down devices which are in the form of pads having one surface engaged with the work and the other exposed to ambient, sea-water pressure. When the engaged surface is evacuated, the pressure differential securely holds the work. The pump evacuates the seawater and, preferably, when evacuation is complete, the motor stalls. Should subsequent leakage occur, its drive is resumed to maintain the pressure differential and the holding force.

BRIEF DESCRIPTION OF THE DRAWINGS

The present invention is illustrated in the accompanying drawings of which:

FIG. 1 is a block diagram of the present seawater evacuation system;

FIG. 4 illustrates a section-type gripper member used in the evacuation system.

DETAILED DESCRIPTION OF THE INVENTION

Figure 3:
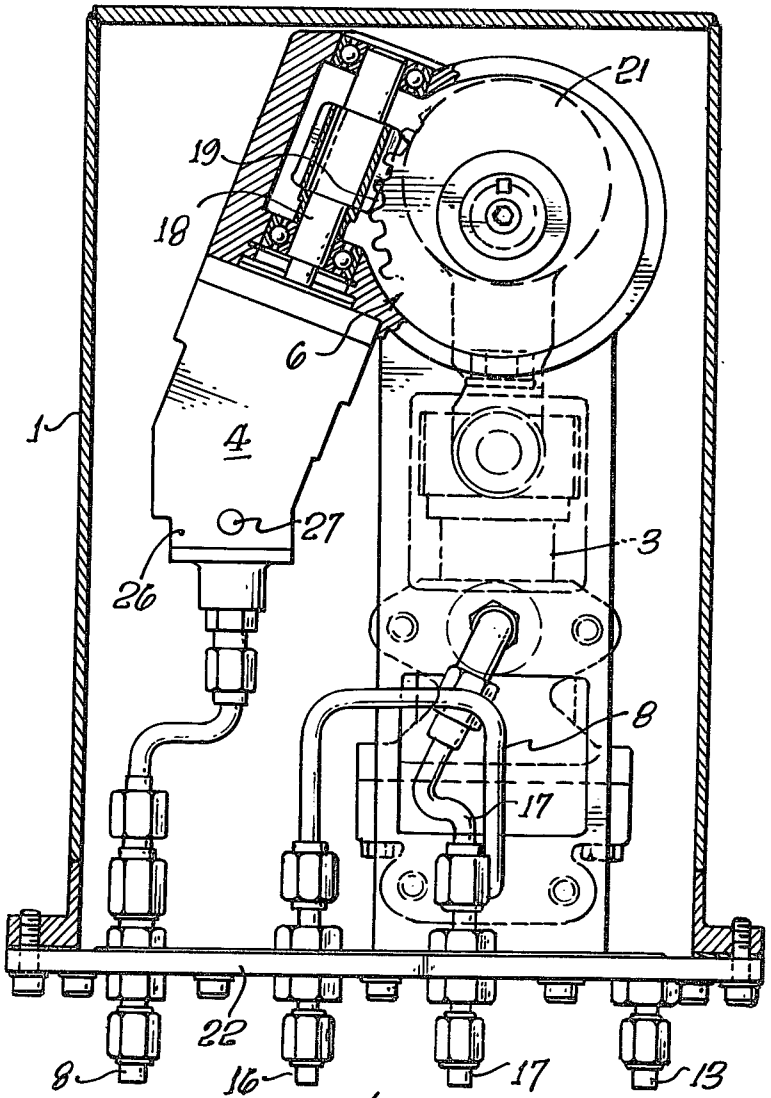
FIG. 3 is another similar but rotated section again showing the interior components in elevation and partial section.

The present evacuation system, as shown in FIG. 1, essentially is a self-contained unit including a thin-walled casing or housing 1 adapted to be easily carried by a diver to the location of the work for application of a particular gripper member 2 to the surface of the work or object to be moved or lifted. The gripping force is established by a pump 3 driven by a motor 4 through reduction gearing 6. The pump evacuates seawater from the gripping surface. Motor 4 is a hydraulic fluid drive motor powered by pressurized hydraulic fluid supplied by a hydraulic supply system 7 through a flexible conduit 8 which couples the supply to the motor. The hydraulic supply system either can be carried by a surface vessel or the like or it can be mounted in a submersible, such as a bottom crawler. To control the motor pressure, the supply includes a flow control 9 and on-off valve 11. For purposes that will be described, another flow control valve 12 can be included in a supply system return line 13.

As will be noted in FIG. 1, return line 13 is not directly coupled to the fluid discharge from motor 4. Instead, as indicated by dotted line 13*a*, the motor discharges directly into casing 1 with return line 13 being coupled directly to the shell of the casing. Also, casing 1 is completely filled with a hydraulic fluid 14 so that the motor, the pump and the reduction gearing all are immersed in this fluid which, preferably, is a lubricant. Obviously, since the motor discharges its fluid directly into the casing, the casing is filled with the same fluid as that which is supplied by system 7. The filling the case with the fluid permits the interior of the casing to be pressurized to compensate for ambient seawater pressure and, because of the compensation, the casing itself can be thin-walled, light and easily transported by the diver. Suction hold-down device 2 is a special member which will be described with reference to FIG. 4. As shown, it has an intake line 16 coupled to pump 3 with pump discharge returned to the seawater environment through line 17.

Figure 2:
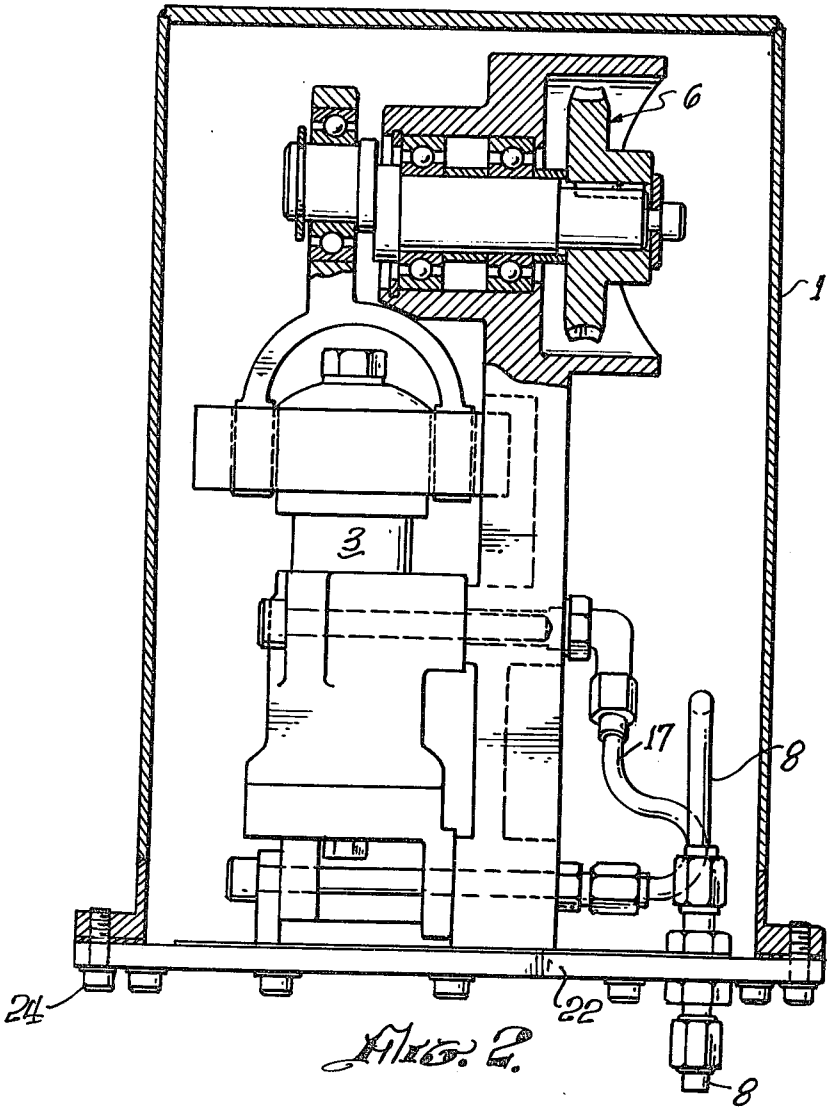
FIG. 2 is a sectional view through the casing of the present evacuation unit showing interior operating components both in elevation and partial section.

Structural details of the seawater evacuation components are shown in FIGS. 2 and 3. However, both the motor and the pump are commercially available components and, of course, other comparable components can be substituted depending upon the functional requirements of the particular system. Since these components are well known, their working parts will be described only in a general manner.

In the illustrated implementation, pump 3 is a Myer's Du-all single-cylinder, double-acting, positive displacement industrial pump, Model No. A02-6-1148507. At 340 rpm, it requires 1.2 hp to develop a flow rate of 2 gpm against its maximum head of 600 psi. Motor 4 is a Vicker's bent-axis hydraulic motor, Model No. MF24-3906-20BC-4 with a theoretical displacement of 0.065 cubic inch/rev., a flow of 2.8 gpm, and power of 5.0 hp. The dry weight of the motor is 2.1 pounds. As best seen in FIG. 3, drive shaft 18 of motor 4 powers pump 3 through a worm 19 and a gear 21 which together form a reducer preferably using a Boston worm and gear Model No. H1407-R and DB-1402 respectively. Housing or casing 1 which contains the motor and pump is a 6061-T6 aluminum case, 13 inches in length by 9¾ inches in diameter. The base of the housing supports the system components and provides inlet and outlet connections for the hydraulic fluid and the seawater. The base is sealed to the casing by means of an O-ring gasket 23 and secured by bolts 24 spaced evenly around the periphery. When assembled and ready for use, the casing is filled with a hydraulic fluid 14 (FIG. 1).

Structurally considered, motor 4 is a typical, fixed-displacement hydraulic motor. It includes a cylinder block and pistons which are displaced by an angle alpha from the center line of drive shaft 18. Piston stroke is a function of the sine of the displacement angle so that the greater the angle of displacement, the greater the torque output for any given piston diameter. The diameter of the pistons, their number and stroke, determine the motor displacement. Hydraulic fluid enters the motor through a valve block 26 and is directed into individual cylinder bores through a non-rotating valve plate which provides the timing for the motor. Pressure, which builds up in the cylinder bores, is transmitted to the pistons and from the piston rods to the drive shaft to overcome the torque resistance of the load connected to the shaft. Motor speed is determined by the amount of fluid supplied to it under the control of flow control valve 9. The hydraulic supply system may be a 3000 psi hydraulic supply which, as indicated, can be carried by a support vessel or by a submersible. As also noted, discharge from motor 4 is applied directly into the interior of casing 1 to fill the casing and maintain a compensating pressure. A discharge opening 27 (FIG. 3) can be used for this purpose and, if desired, a relief valve can be incorporated to permit the discharge to take place even though the motor may be stalled under conditions which will be described.

Pump 3 generally includes a pump plunger vertically actuated by the hydraulic motor through the worm reducer gear which transmits the rotational movement of the motor drive shaft to pump drive and, at the same time, reduces speed from, for example, 6060 rpm to 340 rpm. As the pump plunger is forced up and down, water is drawn in through line 16 and is exhausted through line 17 coupled to a fitting carried by base 22 of the casing. The pumping throughput is dependent upon the pumping speed which, in turn, is a function of gear design and motor speed.

The function of the pump is to evacuate seawater from gripper members 2 shown in FIG. 4. Essentially, member 2 is what can be termed as a 'hold-down' pad in which the hold-down force is applied as a function of the differential pressure between an evacuated surface and ambient seawater pressure. Specifically, the illustrated member includes a plurality of hold-down pads 28 communicated with pump intake line 16 through a reservoir of plenum 29. The hold-down pads have an inner concave gripping surface 31 which, as shown, is applied to the surface of an object 32 which is to be moved or lifted. The opposite or outer surface 33 of the pad is exposed to ambient seawater pressure. When seawater is evacuated from the engaged surface 31, ambient pressure forces the pad into secure engagement with object 32. In a preferred form, the pads also may include small, pin-like members 24 which, in effect, are center punches designed to pierce the engaged surface of object 32 and prevent lateral slippage of members 28. Obviously, any desired number of hold-down pads 28 can be employed although one may suffice depending upon the type of work that is being contemplated.

An important operational aspect of the evacuation system is that, as hold-down pads 28 are evacuated, pump pressure builds up to a point at which the motor stalls. At this point, the object to be worked is securely held by the pads and the holding force, of course, is maintained in the absence of any leakage occuring around the pads. As leakage occurs, the pump pressure decreases and the motor again drives the pump to evacuate it and regain the desired holding pressure.

A further feature of the invention involves the pressure compensation provided by filling the casing with the hydraulic fluid and maintaining an interior pressure sufficient to counter balance the exterior seawater pressure. In this regard, it may be noted that the present system is designed for operation at depths of about 2000 fsw which approximates the working depth permitted for divers. At such a depth, the casing must be sufficiently rigid to withstand exterior pressures. Although rigidity, of course, can be provided by relatively heavy pressure vessel arrangements, the present desire is to provide small, light weight assembly that easily can be carried by the diver. The desire for the light weight, such as the present weight of 28 pounds, dictates the need for a thin-walled casing which, in turn, requires the pressure compensation. The interior casing pressure is maintained by assuring a sufficient pressure differential between the supply and return of the hydraulic supply system. Thus, as presently used, the pressurized supply to the motor may be in the order of 3000 psi with the hydraulic fluid constantly being discharged into the casing interior. The return from the casing through return line 13 may be controlled by a flow control valve 12 (FIG. 1) although such a control valve is not needed if the supply system is, for example, located at the sea surface. In this instance, the weight of the hydraulic fluid is sufficient to establish a pressure within the casing sufficient to withstand exterior pressures. The pressure difference used to compensate exterior pressure also is maintained when the motor stalls due to complete evacuation of the seawater from the gripper members. If desired, the fluid discharge from the motor then can be continued by incorporating a relief valve controlling discharge through a discharge opening 27 (FIG. 3). Such an arrangement is not essential if the supply pressure is adequate.

The advantages of the present arrangement have been discussed in some detail. Primarily, an evacuation system is provided which is sufficiently light to be easily carried by a diver and which is pressure compensated for safe and reliable operation at substantial ocean depths. The pressure compensation feature provided by hydraulic fluid 14 also achieves the additional benefit of providing lubrication for the immersed motor, pump and gear components. Further, since the pump and motor are immersed in the pressurized environment, there is a substantial amount of pressure exerted on them which is quite helpful in preventing motor seal blow-outs and the like. The hold-down grippers also contribute to the reliability of the system. Thus, as already noted, instead of being a suction device in the strict sense of the term, the hold-down or gripping pressure is established through differential pressure conditions existing between the evacuated gripping surface and the seawater. Differential pressures in excess of 300 psi are readily attained at depths up to or greater than 2000 fsw. Further, the use of commercially-available components significantly simplifies implementation. In this regard, although such evacuation pumps are commercially-available items, so far as is known, they have not been adapted specifically to underwater operations.

Obviously many modifications and variations of the present invention are possible in the light of the above teachings. It is therefore to be understood that within the scope of the appended claims the invention may be practiced otherwise than as specifically described.

I claim:

1. Submersible apparatus for evacuating seawater from suction-like work-handling members comprising:
   - a sealed fluid-filled casing adapted to be submersed in seawater, the casing having an outer wall surface directly exposed to ambient seawater pressure,
   - a work-engaging gripper member carried externally of the casing and having an inner work-engaging surface and an outer surface exposed to ambient seawater pressure,
   - fluid-driven power means disposed within said casing and communicably coupled to said gripper member for evacuating seawater from the space between said inner surface and said work whereby a differential gripping pressure can be established for holding said gripper member securely on said work, and
   - means operatively associated with said fluid power means for maintaining a casing fluid pressure sufficient to effectively balance ambient seawater pressures,
   - said casing being a thin-walled light-weight manually portable structure adapted for deep-submergence work in an ambient pressure environment capable of producing a differential gripping pressure in excess of 300 psi, said wall structure being sufficiently light to protectively utilize said pressure balance at said depths.

2. The apparatus of claim 1 wherein said fluid power means includes a hydraulic fluid drive motor having a fluid outlet discharging directly into said fluid-filled casing for pressurizing said casing interior.

3. The apparatus of claim 2 wherein said means for maintaining said casing fluid pressure includes:
   - hydraulic fluid supply means having a pressurized fluid supply line connected through said casing to said drive motor and a fluid return line coupled to said casing for receiving said casing fluid,
   - the flow in said supply and return lines having a fluid pressure differential sufficient to maintain said pressure balance.

4. The apparatus of claim 2 wherein said fluid power means further includes:
   - a seawater pump, and
   - transmission means coupled to said motor for driving said pump.

5. The apparatus of claim 4 wherein said casing and supply fluid is a lubricant,
   - said motor, pump and transmission means being immersed in said fluid for lubricating its exposed components.

6. The apparatus of claim 5 wherein said transmission means is a reduction gear assembly.

7. The apparatus of claim 4 wherein said fluid power means is adapted to stall when seawater is evacuated from said space and to resume evacuation when seawater subsequently leaks into the space.

8. The apparatus of claim 7 wherein said pump is communicably coupled to said gripper member by a flexible conduit means,
   - said conduit means including:
   - a pump intake line communicably coupled to said inner surface through said casing, and
   - a return line discharging said pump externally through said casing.

9. The apparatus of claim 8 wherein said gripper member is supported externally of said casing by said pump intake line, said intake line being a flexible conduit.

* * * * *